US009375945B1

(12) United States Patent
Bowles

(10) Patent No.: US 9,375,945 B1
(45) Date of Patent: Jun. 28, 2016

(54) MEDIA GATE FOR THERMAL TRANSFER PRINTERS

(71) Applicant: Hand Held Products, Inc., Fort Mill, SC (US)

(72) Inventor: Jason Dean Lewis Bowles, Swisher, IA (US)

(73) Assignee: Hand Held Products, Inc., Fort Mills, SC (US)

( * ) Notice: Subject to any disclaimer, the term of this patent is extended or adjusted under 35 U.S.C. 154(b) by 0 days.

(21) Appl. No.: 14/580,262

(22) Filed: Dec. 23, 2014

(51) Int. Cl.
*B41J 2/325* (2006.01)

(52) U.S. Cl.
CPC ..... *B41J 2/325* (2013.01)

(58) Field of Classification Search
USPC ..... 347/171, 176, 101, 103–106, 212–215, 347/217; 400/234, 235
See application file for complete search history.

(56) References Cited

U.S. PATENT DOCUMENTS 5,001,498 A * 3/1991 Shimizu ..... B41J 15/06 347/215
5,266,969 A * 11/1993 Mochizuki ..... B41J 2/325 347/172
6,078,346 A * 6/2000 Isobe ..... B41J 15/005 347/172
6,304,281 B1 * 10/2001 Weichmann ..... B41C 1/1091 347/217
7,938,588 B2 * 5/2011 Yokoyama ..... B41J 2/325 347/213
2005/0212891 A1 * 9/2005 Imamura ..... B41J 2/0057 347/177

* cited by examiner

*Primary Examiner* — Kristal Feggins
(74) *Attorney, Agent, or Firm* — Additon, Higgins & Pendelton, P.A.

(57) ABSTRACT

A thermal transfer printer having a media gate and a method for its use are presented. The media gate prevents the improper loading of thermal transfer paper and/or thermal transfer ribbon into a thermal transfer printer by preventing access to the wrong track. In this way, a user cannot feed (i.e., route) the paper/ribbon along the wrong track (i.e., path) when loading (or reloading) paper/ribbon into the thermal transfer printer. In some embodiments, the media gate may have printing (e.g., icons) to provide a user with guidance for proper media loading.

20 Claims, 4 Drawing Sheets

MEDIA GATE FOR THERMAL TRANSFER PRINTERS

FIELD OF THE INVENTION

The present invention relates to thermal transfer printers and, more specifically, to a mechanism for preventing the improper loading of media into these printers.

BACKGROUND

Thermal transfer printing includes transferring ink from a thermal transfer ribbon (i.e., ribbon, ink ribbon, transfer ribbon, transfer film) to thermal transfer paper (i.e., paper, paper stock, label, tag) using heat, pressure, and peeling. The media (i.e., paper/ribbon) used for printing must be replenished regularly by reloading the thermal transfer printer (i.e., printer). While performed regularly, the loading of paper/ribbon may occur infrequently enough that mistakes may occur.

Thermal transfer paper/ribbon is typically packaged in spools. Loading the paper/ribbon into a thermal transfer printer often requires mounting a spool of the paper/ribbon onto a spindle and feeding a portion of the wound material along a precise path (i.e., track) through the thermal transfer printer. A common mistake is feeding the paper/ribbon through the wrong path (i.e., misfeed). Misfeeding paper/ribbon in a thermal transfer printer can lead to poor print quality, printer downtime, media waste, and/or unforeseen expense. Since thermal transfer printers are often used in environments (e.g., manufacturing, shipping, etc.) that are especially sensitive to these conditions, a need exists for means/method to help eliminate misfeeding media when loading (or reloading) thermal transfer printers.

SUMMARY

Accordingly, in one aspect, the present invention embraces a method for preventing the improper loading of media into a thermal transfer printing. The method begins with the step of obtaining access to a media loading area of a thermal transfer printer. The media loading area includes a thermal transfer paper track and a thermal transfer ribbon track. The thermal transfer paper must be routed along the thermal transfer paper track and the thermal transfer ribbon must be routed along the thermal transfer ribbon track for thermal transfer printing. Next, a media gate is positioned so access to, at least part of, the thermal transfer ribbon track is prevented. The thermal transfer paper is then loaded into the thermal transfer printer and routed along the thermal transfer paper track.

In an exemplary embodiment, the method includes steps for loading the thermal transfer ribbon after the thermal transfer paper is routed along the thermal transfer paper track. Here, the method includes the step of positioning the media gate so that access to at least part of the thermal transfer paper track is prevented. Next, the method includes the step of loading the thermal transfer ribbon into the thermal transfer printer. Finally, the method includes the step of routing the thermal transfer ribbon along the thermal transfer ribbon track.

In another exemplary embodiment, the method's step of positioning the media gate includes covering at least part of the thermal transfer ribbon track with a portion of the media gate.

In another exemplary embodiment, the media gate is a rectangular plate that is hingedly connected, like a door, to the thermal transfer printer.

In another exemplary embodiment, the media gate is a rectangular plate that is hingedly connected, like a door, to the thermal transfer printer, and held in a position by a magnetic hasp so that access to at least part of the thermal transfer ribbon track is prevented.

In another exemplary embodiment, the media gate is a rectangular plate that is hingedly connected, like a door, to the thermal transfer printer, and has printing on a side (or both sides) to aid a user with loading media into the thermal transfer printer.

In another exemplary embodiment, the media gate is a rectangular plate that is hingedly connected, like a door, to the thermal transfer printer, and has an icon (or icons) printed on a side (or both sides) to aid a user with loading media into the thermal transfer printer.

In another aspect, the present invention embraces a method for preventing the improper loading of a thermal transfer ribbon into a thermal transfer printer. The method includes the step of obtaining access to a media loading area of a thermal transfer printer. The media loading area includes (i) a thermal transfer paper track that thermal transfer paper must be routed along for thermal transfer printing and (ii) a thermal transfer ribbon track that the thermal transfer ribbon must be routed along for thermal transfer printing. The method next includes the step of positioning a media gate so that access to at least part of the thermal transfer paper track is prevented. Next, the method includes the step of loading the thermal transfer ribbon into the thermal transfer printer. Finally, the method includes the step of routing the thermal transfer ribbon along the thermal transfer ribbon track.

In an exemplary embodiment, the method's step of positioning the media gating includes covering at least part of the thermal transfer paper track with a portion of the media gate.

In another exemplary embodiment, the media gate is a rectangular plate that is hingedly connected, like a door, to the thermal transfer printer.

In another exemplary embodiment, the media gate is held in a position by a magnetic hasp so that access to, at least a part of, the thermal transfer paper track is prevented.

In another exemplary embodiment, the media gate includes printing on a side (or sides) to aid a user with loading media into the thermal transfer printer.

In another exemplary embodiment, the media gate includes an icon (or icons) printed on a side (or sides) to aid a user with loading media into the thermal transfer printer.

In another aspect, the present embraces a thermal transfer printer. The thermal transfer printer includes a paper track that continuous feed thermal transfer paper must be routed along for thermal transfer printing. The thermal transfer printer also includes a ribbon track that a thermal transfer ribbon must be routed along for thermal transfer printing. Also included is a media gate. The media gate is configurable in either a ribbon loading position or a paper loading position. When the media gate is in the ribbon loading position, access to (at least part of) the paper track is closed, while access to the ribbon track is open. When the media gate is in the paper loading position, access to (at least part of) the ribbon track is closed, while access to the paper track is open.

In an exemplary embodiment, the media gate is a door with a pin on one side that is hingedly connected to the thermal transfer printer.

In another possible exemplary embodiment, the media gate is a door with a pin on one side that is hingedly connected to the thermal transfer printer. The media gate can be rotated 180 degrees about a gate axis collinear with the pin to change between the ribbon loading position and the paper loading position.

In another possible exemplary embodiment, the media gate is a door with a pin on one side that is hingedly connected to the thermal transfer printer. The media gate is metal and a portion of the media gate is folded around the pin to hold it in place.

In another possible exemplary embodiment, the media gate is a door with a pin on one side that is hingedly connected to the thermal transfer printer. The media gate also includes a magnet to hold the media gate in either the ribbon loading position or the paper loading position.

In another possible exemplary embodiment, the media gate is a door with a pin on one side that is hingedly connected to the thermal transfer printer. The media gate has printing on (i) a first side that is visible when the media gate is in the ribbon loading position and (ii) a second side that is visible when the media gate is in the paper loading position.

In another possible exemplary embodiment, the media gate is a door with a pin on one side that is hingedly connected to the thermal transfer printer. The media gate has printing on (i) a first side that is visible when the media gate is in the ribbon loading position and (ii) a second side that is visible when the media gate is in the paper loading position. The printing includes icons to help a user with loading the thermal transfer ribbon and/or the thermal transfer paper.

The foregoing illustrative summary, as well as other exemplary objectives and/or advantages of the invention, and the manner in which the same are accomplished, are further explained within the following detailed description and its accompanying drawings.

The figures are provided to represent exemplary embodiments and to describe the various teachings and features of the present invention. The figures are not meant to limit the present disclosure, which may include other embodiments as would be understood by one of ordinary skill in the art. In addition, the drawings are not necessarily drawn to scale and may represent any devices understood to be within the spirit and scope of the present disclosure.

DETAILED DESCRIPTION

The present invention embraces a thermal transfer printer (i.e., printer) with a media gate and methods for its use to prevent the improper loading (or reloading) of media (i.e., paper/ribbon) into the printer.

Thermal transfer printing is valued for being quiet, reliable, clean, and simple. It is a cost efficient way to generate high-quality printed alphanumeric text and/or graphics (e.g., barcodes) for applications that require many printed items and where the printing may change slightly for each printed item. Labels (e.g., shipping, product, barcodes, etc.), for example, are often printed using thermal transfer printers. Thermal transfer printers typically use a thermal transfer ribbon (i.e., ribbon, ink ribbon, transfer ribbon, transfer film) comprising an ink (e.g., wax or resin based ink) layer deposited on a thin (e.g., 1-10 microns) carrier layer (e.g., polyester film). The ink has a low melting point, and the ink may be melted when it is brought in proximity with a thermal element (i.e., print-head) having electrically controlled heating elements. To print, the ribbon is interposed between the print-head and thermal transfer paper (i.e., paper, paper stock, label, tag) so that the ink surface of the ribbon is contiguous with the paper (e.g., plain cellulous pulp paper, bond paper, plastic paper, coated paper, etc.). A platen helps to push the paper and ribbon against the print head and may facilitate paper/ribbon movement. As the paper/ribbon move under the stationary print-head, thermal energy may be applied to the ribbon to melt the ink onto the paper. As paper/ribbon move past the print head along separate paths, the ribbon is peeled from the paper leaving a layer of ink in the regions that were exposed to heat from the print-head.

Figure 1:
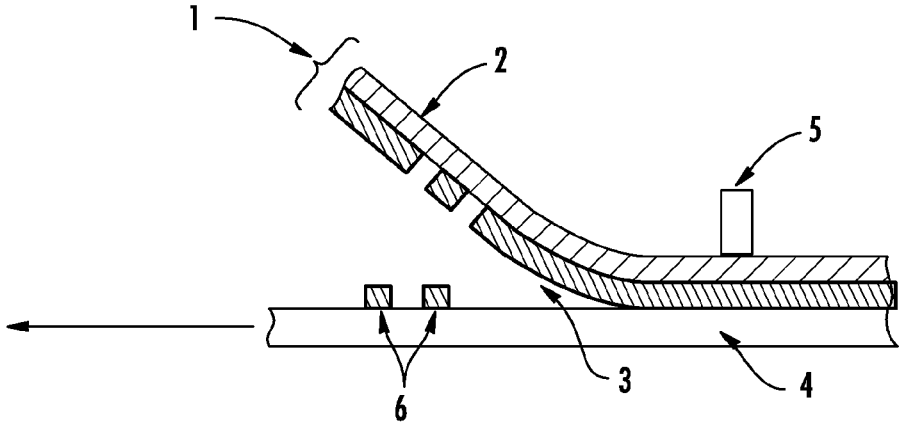
FIG. 1 graphically depicts a side view of the thermal transfer printing process according to an embodiment of the present invention.

FIG. 1 graphically depicts a side view of the thermal transfer printing process. The ribbon 1 has an ink layer 3 and a carrier layer 2. The ribbon 1 and the paper 4 move along a path bringing them together under the print-head 5. The print-head 5 applies heat (at specific moments and at specific locations) to form printed marks 6 on the paper. The print-head may have a plurality of individually controlled heating elements arranged in a linear array. These elements may be used to form text/graphic printing on the paper line-by-line as the paper moves underneath the print-head. The paper and ribbon are typically continuously fed from spools that must be replenished regularly.

The quality of thermal transfer printing depends on a range of variables relating to the heating, pressure, and peeling requirements for a particular selection of paper, ribbon, and printing speed. A thermal transfer printer must control these variables to achieve consistent, high-quality printing. As a result, various mechanisms in the thermal printer control the position and routing of the media.

Figure 2:
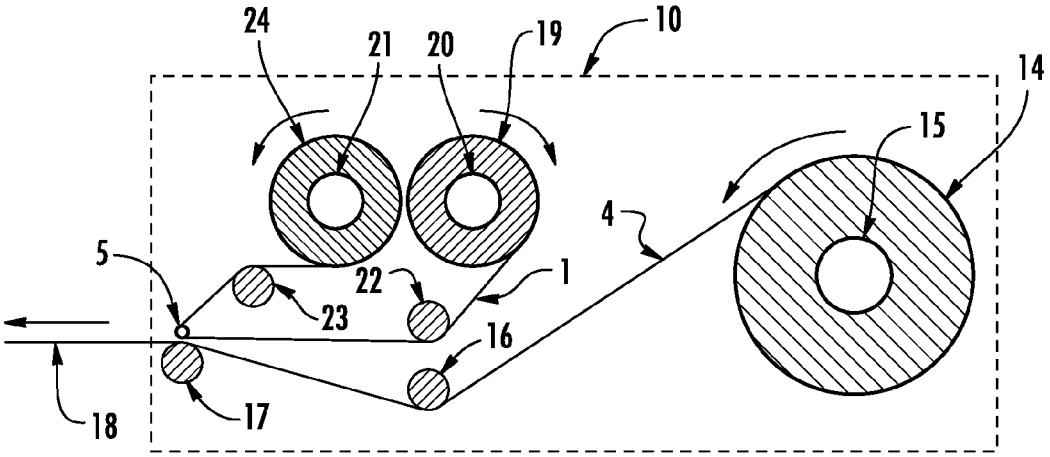
FIG. 2 graphically depicts a side view of a media loading area of a properly loaded thermal transfer printer, according to an embodiment of the present invention.

FIG. 2 graphically depicts a side view of these mechanisms in a rudimentary portrayal of an exemplary thermal transfer printer. Portrayed in this figure is the thermal transfer printer's media loading area 10. In this area, a paper spool 14 is mounted on a paper spindle 15 so that it is free to rotate and supply a continuous sheet of paper 4. The paper is routed past a paper director 16 and a platen 17 to form the thermal transfer paper track. The paper director and platen are free to rotate and guide and/or propel the paper 4 through the printer, under the print-head 5 for printing, and out of the of the thermal transfer printer as a printed item 18. During operation, the paper spool 14 is emptied.

A ribbon-supply spool 19 mounted on a ribbon-supply spindle 20 is also found in the media loading area. The ribbon-supply spool 19 contains a supply of continuous-feed ribbon. The ribbon 1 is routed past a ribbon-supply director 22 to the print head 5, where it is heated for printing. The used ribbon is peeled from the paper and routed past a ribbon-take-up director 23 and wound onto a ribbon-take-up spool 24 mounted on a ribbon-take-up spindle 21. During printing, the ribbon-supply spool 19 and ribbon-take-up spool 24 shown in FIG. 2 rotate clockwise and counter-clockwise respectively but this rotation may vary in other embodiments. During operation, the ribbon-supply spool 19 is emptied while the ribbon-take-up spool 24 is filled.

Figure 3:
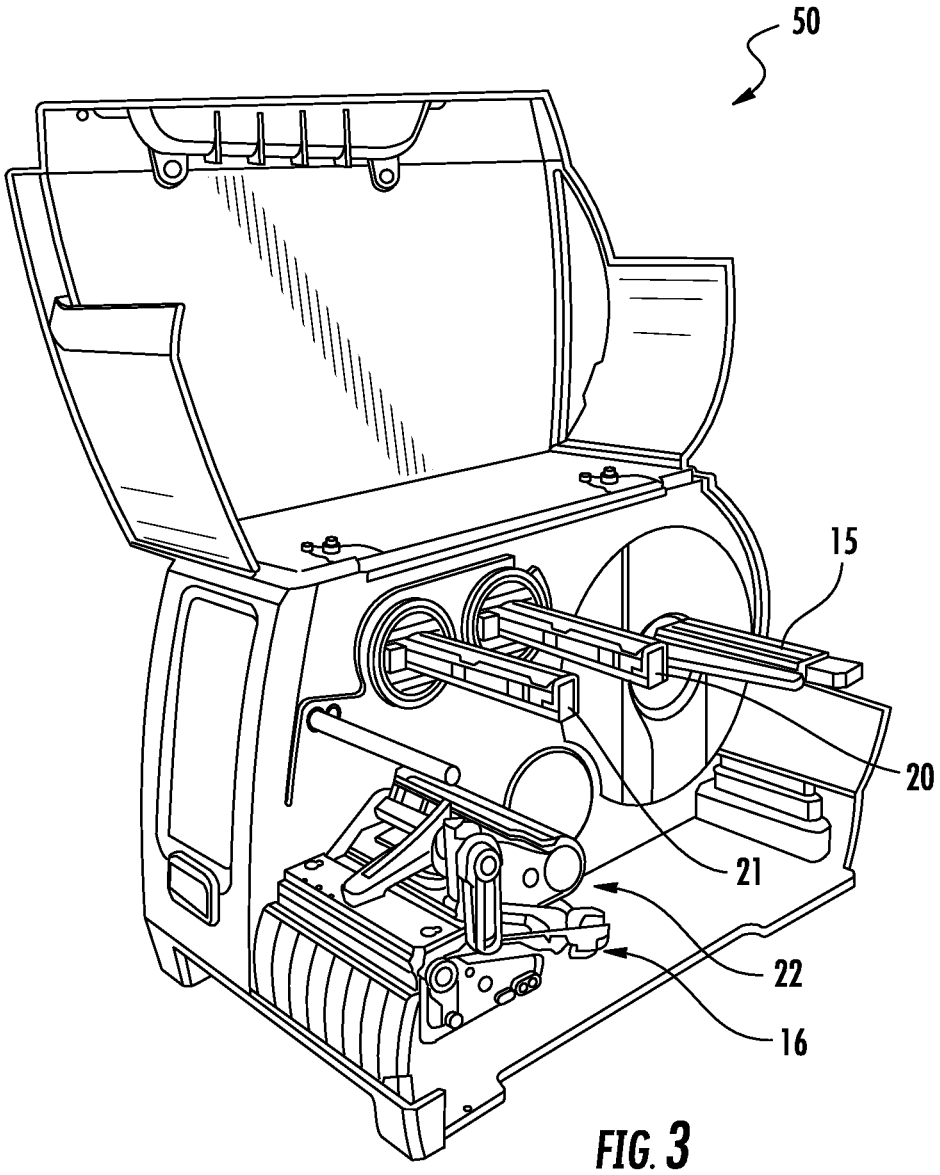
FIG. 3 graphically depicts a perspective view of a thermal transfer printer with a case opened to expose the media loading area, according to an embodiment of the present invention.

Periodically it is necessary to reload the media in the thermal transfer printer. Sometimes this is due to an empty spool (or spools), while other times it may be due to regular or unforeseen maintenance. In any case, the loading of either paper and/or ribbon requires several steps. First, a user must obtain access to the media loading area 10. FIG. 3 graphically depicts a perspective view of a possible embodiment of a thermal transfer printer 50. In this embodiment, access to the media loading area is obtained by opening the case. The mechanisms in this area are complex and, as a result, it may not be obvious from inspection how to load the paper and/or ribbon. As a result, loading errors (i.e., misfeeds, misloading) may occur.

There are various types of loading errors and the symptoms of a loading error may vary. A common loading error occurs when the printable stock (i.e., paper) is routed along thermal transfer ribbon track instead of the thermal transfer paper track. This loading error places the paper outside of its appropriate area so that sensors (e.g., photo detectors) used to detect the paper inside the printer may indicate that the printer is out of paper rather than indicating a loading error.

Another loading error occurs when a user loads the ribbon along thermal transfer paper track instead of the thermal transfer ribbon track. Here the sensors in the paper error may detect that the dark ribbon is installed rather than the (typically) light colored paper, and may cause the printer to indicate that there has been a loading error.

The two error types described so far typically occur when setting up a new printer or reactivating a dormant printer. In both cases, the printer may not have any media loaded. This situation is especially prone to errors since loaded media could help a user visualize the routing paths necessary for loading.

A third loading error type occurs when the paper/ribbon is run through an improper route. This route may be partially correct and, in this way, may not trigger sensors in the printer to indicate loading errors. In fact, in some situations a user might be able to print. Printing in this condition, however, may suffer some degradation of quality or other unwanted printer behavior. This unwanted behavior may be transient and unpredictable, making these types of errors especially annoying.

Figure 4:
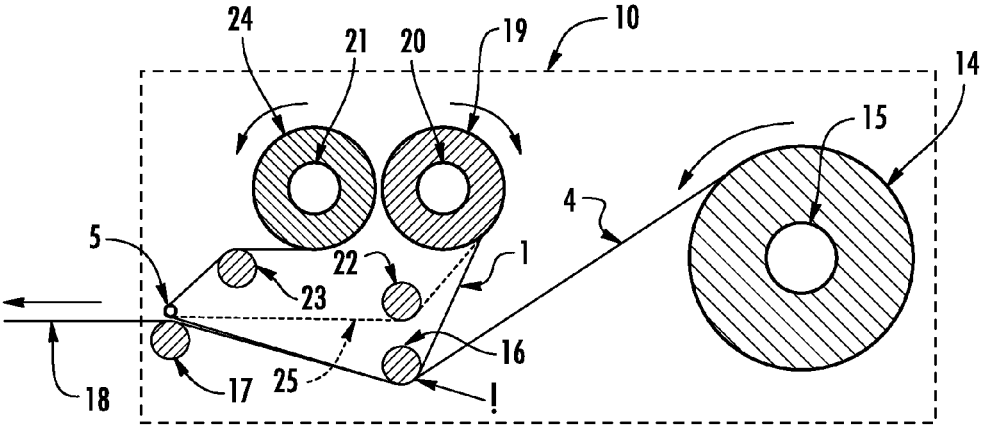
FIG. 4 graphically depicts a side view of the media loading area of an improperly loaded thermal transfer printer, according to an embodiment of the present invention.

FIG. 4 graphically depicts a side view of the media loading area of an improperly loaded thermal transfer printer, according to an embodiment of the present invention. Here the ribbon 1 has not been proper routed along the thermal track 25. Instead, the ribbon has been routed around the paper director 16. As a result, the paper and the ribbon make contact before reaching the pint-head 5, which may cause some unwanted results (e.g., poor print quality).

To prevent media loading errors, a media gate may be installed into the thermal transfer printer. The media gate may be retrofit into existing printers or installed in printers as they are originally manufactured. The media gate limits access to either the thermal transfer paper track or the thermal transfer ribbon track depending on its position. For example, a media gate may be configurable in either (i) a ribbon loading position or (ii) a paper loading position. In the ribbon loading position, access to at least part of the paper track is closed while access to the ribbon track is open. In the paper loading position, access to at least part of the ribbon track is closed while access to the paper track is open.

Figure 5:
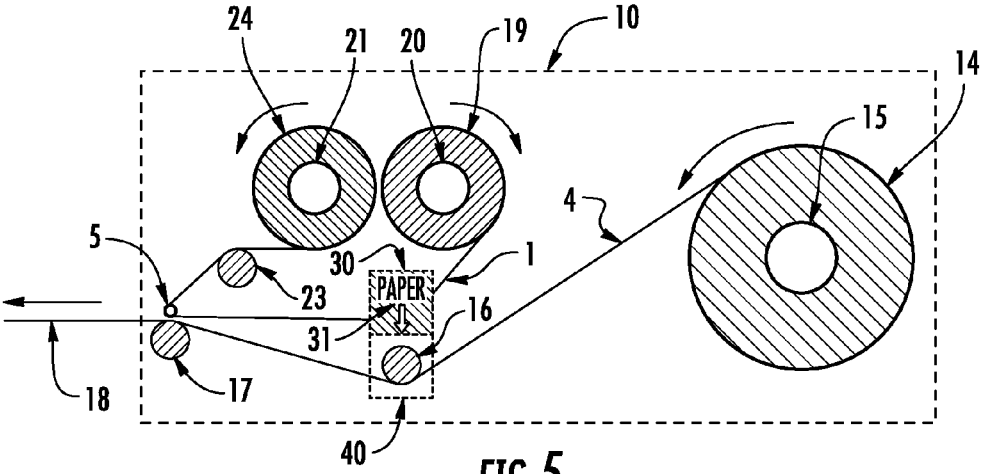
FIG. 5 graphically depicts a side view of the media loading area of a thermal transfer printer with a media gate in a paper loading position, according to an embodiment of the present invention.

FIG. 5 graphically depicts a side view of the media loading area of a thermal transfer printer with a media gate in a paper loading position. Here, the media gate 30 covers a portion of the ribbon track while allowing access to the paper track 40. Markings (e.g., printing, embossed marks, etc.) 31 on the media gate 30 provide a user with prompts that may help paper loading. In some embodiments, the media gate is a covering (e.g., metal plate) that is hingedly connected (like a door) to the thermal transfer printer. The media gate may be held in position via a magnet that serves as a magnetic hasp for the door.

Figure 6:
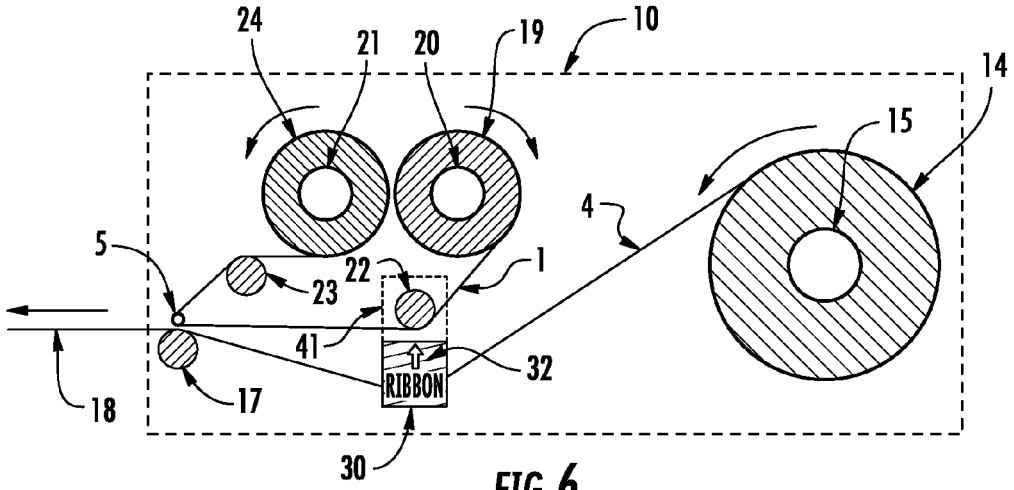
FIG. 6 graphically depicts a side view of the media loading area of a thermal transfer printer with a media gate in a ribbon loading position, according to an embodiment of the present invention.

FIG. 6 graphically depicts a side view of the media loading area of a thermal transfer printer with a media gate 30 in a paper loading position. Here, the media gate has be rotated 180 degrees about a gate axis that is aligned with the hinged connection between the media gate and the printer. The media gate 30 covers a portion of the paper track while allowing access to the ribbon track 41. Markings (e.g., printing) 32 on the media gate 30 provide a user with prompts that may help with ribbon loading.

Figure 7:
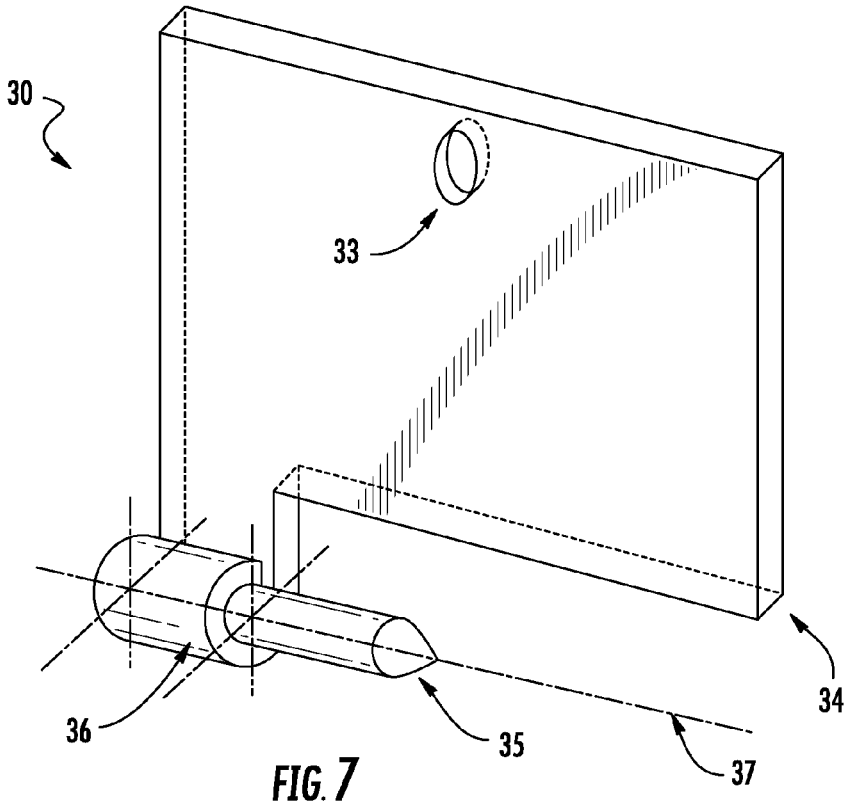
FIG. 7 graphically depicts a perspective view of a media gate according to an embodiment of the present invention.

FIG. 7 graphically depicts a perspective view of a media gate 30 according to an embodiment of the present invention. The media gate includes a door 34 (i.e., flap). The door may be made from metal, plastic, or other sturdy material. A pin 35 may be affixed on one side of the door 35 by various means. For example, the pin may be held in place by folding a portion of the media 36 gate material around the pin, as shown in FIG. 7. The pin 35 allows the media gate to be hingedly connected to the thermal transfer printer so that it can rotate about a gate axis 37 collinear with the pin 35. A magnet 33 may be affixed to the door 34 in order to hold the media gate in a particular position by forcibly connecting the media gate to a ferrous surface in the thermal transfer printer.

To supplement the present disclosure, this application incorporates entirely by reference the following commonly assigned patents, patent application publications, and patent applications:

U.S. Pat. No. 6,832,725; U.S. Pat. No. 7,128,266;
U.S. Pat. No. 7,159,783; U.S. Pat. No. 7,413,127;
U.S. Pat. No. 7,726,575; U.S. Pat. No. 8,294,969;
U.S. Pat. No. 8,317,105; U.S. Pat. No. 8,322,622;
U.S. Pat. No. 8,366,005; U.S. Pat. No. 8,371,507;
U.S. Pat. No. 8,376,233; U.S. Pat. No. 8,381,979;
U.S. Pat. No. 8,390,909; U.S. Pat. No. 8,408,464;
U.S. Pat. No. 8,408,468; U.S. Pat. No. 8,408,469;
U.S. Pat. No. 8,424,768; U.S. Pat. No. 8,448,863;
U.S. Pat. No. 8,457,013; U.S. Pat. No. 8,459,557;
U.S. Pat. No. 8,469,272; U.S. Pat. No. 8,474,712;
U.S. Pat. No. 8,479,992; U.S. Pat. No. 8,490,877;
U.S. Pat. No. 8,517,271; U.S. Pat. No. 8,523,076;
U.S. Pat. No. 8,528,818; U.S. Pat. No. 8,544,737;
U.S. Pat. No. 8,548,242; U.S. Pat. No. 8,548,420;
U.S. Pat. No. 8,550,335; U.S. Pat. No. 8,550,354;
U.S. Pat. No. 8,550,357; U.S. Pat. No. 8,556,174;
U.S. Pat. No. 8,556,176; U.S. Pat. No. 8,556,177;
U.S. Pat. No. 8,559,767; U.S. Pat. No. 8,599,957;
U.S. Pat. No. 8,561,895; U.S. Pat. No. 8,561,903;
U.S. Pat. No. 8,561,905; U.S. Pat. No. 8,565,107;
U.S. Pat. No. 8,571,307; U.S. Pat. No. 8,579,200;
U.S. Pat. No. 8,583,924; U.S. Pat. No. 8,584,945;
U.S. Pat. No. 8,587,595; U.S. Pat. No. 8,587,697;
U.S. Pat. No. 8,588,869; U.S. Pat. No. 8,590,789;
U.S. Pat. No. 8,596,539; U.S. Pat. No. 8,596,542;
U.S. Pat. No. 8,596,543; U.S. Pat. No. 8,599,271;
U.S. Pat. No. 8,599,957; U.S. Pat. No. 8,600,158;
U.S. Pat. No. 8,600,167; U.S. Pat. No. 8,602,309;
U.S. Pat. No. 8,608,053; U.S. Pat. No. 8,608,071;
U.S. Pat. No. 8,611,309; U.S. Pat. No. 8,615,487;
U.S. Pat. No. 8,616,454; U.S. Pat. No. 8,621,123;

U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,526; U.S. Pat. No. 8,798,367; U.S. Pat. No. 8,807,431; U.S. Pat. No. 8,807,432; U.S. Pat. No. 8,820,630;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2011/0202554;
U.S. Patent Application Publication No. 2012/0111946;
U.S. Patent Application Publication No. 2012/0138685;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0056285;
U.S. Patent Application Publication No. 2013/0070322;
U.S. Patent Application Publication No. 2013/0075168;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0200158;
U.S. Patent Application Publication No. 2013/0256418;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0278425;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306730;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0341399;
U.S. Patent Application Publication No. 2013/0342717;
U.S. Patent Application Publication No. 2014/0001267;
U.S. Patent Application Publication No. 2014/0002828;
U.S. Patent Application Publication No. 2014/0008430;
U.S. Patent Application Publication No. 2014/0008439;
U.S. Patent Application Publication No. 2014/0025584;
U.S. Patent Application Publication No. 2014/0027518;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061305;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0075846;
U.S. Patent Application Publication No. 2014/0076974;
U.S. Patent Application Publication No. 2014/0078341;
U.S. Patent Application Publication No. 2014/0078342;
U.S. Patent Application Publication No. 2014/0078345;
U.S. Patent Application Publication No. 2014/0084068;
U.S. Patent Application Publication No. 2014/0097249;
U.S. Patent Application Publication No. 2014/0098792;
U.S. Patent Application Publication No. 2014/0100774;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0108682;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;

U.S. Patent Application Publication No. 2014/0152882;
U.S. Patent Application Publication No. 2014/0158770;
U.S. Patent Application Publication No. 2014/0159869;
U.S. Patent Application Publication No. 2014/0160329;
U.S. Patent Application Publication No. 2014/0166755;
U.S. Patent Application Publication No. 2014/0166757;
U.S. Patent Application Publication No. 2014/0166759;
U.S. Patent Application Publication No. 2014/0166760;
U.S. Patent Application Publication No. 2014/0166761;
U.S. Patent Application Publication No. 2014/0168787;
U.S. Patent Application Publication No. 2014/0175165;
U.S. Patent Application Publication No. 2014/0175169;
U.S. Patent Application Publication No. 2014/0175172;
U.S. Patent Application Publication No. 2014/0175174;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0203087;
U.S. Patent Application Publication No. 2014/0204268;
U.S. Patent Application Publication No. 2014/0214631;
U.S. Patent Application Publication No. 2014/0217166;
U.S. Patent Application Publication No. 2014/0217180;
U.S. patent application Ser. No. 13/367,978 for a Laser Scanning Module Employing an Elastomeric U-Hinge Based Laser Scanning Assembly, filed Feb. 7, 2012 (Feng et al.);
U.S. patent application Ser. No. 29/436,337 for an Electronic Device, filed Nov. 5, 2012 (Fitch et al.);
U.S. patent application Ser. No. 13/771,508 for an Optical Redirection Adapter, filed Feb. 20, 2013 (Anderson);
U.S. patent application Ser. No. 13/852,097 for a System and Method for Capturing and Preserving Vehicle Event Data, filed Mar. 28, 2013 (Barker et al.);
U.S. patent application Ser. No. 13/902,110 for a System and Method for Display of Information Using a Vehicle-Mount Computer, filed May 24, 2013 (Hollifield);
U.S. patent application Ser. No. 13/902,144, for a System and Method for Display of Information Using a Vehicle-Mount Computer, filed May 24, 2013 (Chamberlin);
U.S. patent application Ser. No. 13/902,242 for a System For Providing A Continuous Communication Link With A Symbol Reading Device, filed May 24, 2013 (Smith et al.);
U.S. patent application Ser. No. 13/912,262 for a Method of Error Correction for 3D Imaging Device, filed Jun. 7, 2013 (Jovanovski et al.);
U.S. patent application Ser. No. 13/912,702 for a System and Method for Reading Code Symbols at Long Range Using Source Power Control, filed Jun. 7, 2013 (Xian et al.);
U.S. patent application Ser. No. 29/458,405 for an Electronic Device, filed Jun. 19, 2013 (Fitch et al.);
U.S. patent application Ser. No. 13/922,339 for a System and Method for Reading Code Symbols Using a Variable Field of View, filed Jun. 20, 2013 (Xian et al.);
U.S. patent application Ser. No. 13/927,398 for a Code Symbol Reading System Having Adaptive Autofocus, filed Jun. 26, 2013 (Todeschini);
U.S. patent application Ser. No. 13/930,913 for a Mobile Device Having an Improved User Interface for Reading Code Symbols, filed Jun. 28, 2013 (Gelay et al.);
U.S. patent application Ser. No. 29/459,620 for an Electronic Device Enclosure, filed Jul. 2, 2013 (London et al.);
U.S. patent application Ser. No. 29/459,681 for an Electronic Device Enclosure, filed Jul. 2, 2013 (Chaney et al.);
U.S. patent application Ser. No. 13/933,415 for an Electronic Device Case, filed Jul. 2, 2013 (London et al.);
U.S. patent application Ser. No. 29/459,785 for a Scanner and Charging Base, filed Jul. 3, 2013 (Fitch et al.);
U.S. patent application Ser. No. 29/459,823 for a Scanner, filed Jul. 3, 2013 (Zhou et al.);
U.S. patent application Ser. No. 13/947,296 for a System and Method for Selectively Reading Code Symbols, filed Jul. 22, 2013 (Rueblinger et al.);
U.S. patent application Ser. No. 13/950,544 for a Code Symbol Reading System Having Adjustable Object Detection, filed Jul. 25, 2013 (Jiang);
U.S. patent application Ser. No. 13/961,408 for a Method for Manufacturing Laser Scanners, filed Aug. 7, 2013 (Saber et al.);
U.S. patent application Ser. No. 14/018,729 for a Method for Operating a Laser Scanner, filed Sep. 5, 2013 (Feng et al.);
U.S. patent application Ser. No. 14/019,616 for a Device Having Light Source to Reduce Surface Pathogens, filed Sep. 6, 2013 (Todeschini);
U.S. patent application Ser. No. 14/023,762 for a Handheld Indicia Reader Having Locking Endcap, filed Sep. 11, 2013 (Gannon);
U.S. patent application Ser. No. 14/035,474 for Augmented-Reality Signature Capture, filed Sep. 24, 2013 (Todeschini);
U.S. patent application Ser. No. 29/468,118 for an Electronic Device Case, filed Sep. 26, 2013 (Oberpriller et al.);
U.S. patent application Ser. No. 14/055,234 for Dimensioning System, filed Oct. 16, 2013 (Fletcher);
U.S. patent application Ser. No. 14/053,314 for Indicia Reader, filed Oct. 14, 2013 (Huck);
U.S. patent application Ser. No. 14/065,768 for Hybrid System and Method for Reading Indicia, filed Oct. 29, 2013 (Meier et al.);
U.S. patent application Ser. No. 14/074,746 for Self-Checkout Shopping System, filed Nov. 8, 2013 (Hejl et al.);
U.S. patent application Ser. No. 14/074,787 for Method and System for Configuring Mobile Devices via NFC Technology, filed Nov. 8, 2013 (Smith et al.);
U.S. patent application Ser. No. 14/087,190 for Optimal Range Indicators for Bar Code Validation, filed Nov. 22, 2013 (Hejl);
U.S. patent application Ser. No. 14/094,087 for Method and System for Communicating Information in an Digital Signal, filed Dec. 2, 2013 (Peake et al.);
U.S. patent application Ser. No. 14/101,965 for High Dynamic-Range Indicia Reading System, filed Dec. 10, 2013 (Xian);
U.S. patent application Ser. No. 14/150,393 for Indicia-reader Having Unitary Construction Scanner, filed Jan. 8, 2014 (Colavito et al.);
U.S. patent application Ser. No. 14/154,207 for Laser Barcode Scanner, filed Jan. 14, 2014 (Hou et al.);
U.S. patent application Ser. No. 14/165,980 for System and Method for Measuring Irregular Objects with a Single Camera filed Jan. 28, 2014 (Li et al.);
U.S. patent application Ser. No. 14/166,103 for Indicia Reading Terminal Including Optical Filter filed Jan. 28, 2014 (Lu et al.);
U.S. patent application Ser. No. 14/200,405 for Indicia Reader for Size-Limited Applications filed Mar. 7, 2014 (Feng et al.);
U.S. patent application Ser. No. 14/231,898 for Hand-Mounted Indicia-Reading Device with Finger Motion Triggering filed Apr. 1, 2014 (Van Horn et al.);
U.S. patent application Ser. No. 14/250,923 for Reading Apparatus Having Partial Frame Operating Mode filed Apr. 11, 2014, (Deng et al.);

U.S. patent application Ser. No. 14/257,174 for Imaging Terminal Having Data Compression filed Apr. 21, 2014, (Barber et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/274,858 for Mobile Printer with Optional Battery Accessory filed May 12, 2014 (Marty et al.);

U.S. patent application Ser. No. 14/277,337 for MULTIPURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/300,276 for METHOD AND SYSTEM FOR CONSIDERING INFORMATION ABOUT AN EXPECTED RESPONSE WHEN PERFORMING SPEECH RECOGNITION, filed Jun. 10, 2014 (Braho et al.);

U.S. patent application Ser. No. 14/305,153 for INDICIA READING SYSTEM EMPLOYING DIGITAL GAIN CONTROL filed Jun. 16, 2014 (Xian et al.);

U.S. patent application Ser. No. 14/310,226 for AUTOFOCUSING OPTICAL IMAGING DEVICE filed Jun. 20, 2014 (Koziol et al.);

U.S. patent application Ser. No. 14/327,722 for CUSTOMER FACING IMAGING SYSTEMS AND METHODS FOR OBTAINING IMAGES filed Jul. 10, 2014 (Oberpriller et al,);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/329,303 for CELL PHONE READING MODE USING IMAGE TIMER filed Jul. 11, 2014 (Coyle);

U.S. patent application Ser. No. 14/333,588 for SYMBOL READING SYSTEM WITH INTEGRATED SCALE BASE filed Jul. 17, 2014 (Barten);

U.S. patent application Ser. No. 14/334,934 for a SYSTEM AND METHOD FOR INDICIA VERIFICATION, filed Jul. 18, 2014 (Hejl);

U.S. patent application Ser. No. 14/336,188 for METHOD OF AND SYSTEM FOR DETECTING OBJECT WEIGHING INTERFERENCES, Filed Jul. 21, 2014 (Amundsen et al.);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/340,716 for an OPTICAL IMAGER AND METHOD FOR CORRELATING A MEDICATION PACKAGE WITH A PATIENT, filed Jul. 25, 2014 (Ellis);

U.S. patent application Ser. No. 14/342,544 for Imaging Based Barcode Scanner Engine with Multiple Elements Supported on a Common Printed Circuit Board filed Mar. 4, 2014 (Liu et al.);

U.S. patent application Ser. No. 14/345,735 for Optical Indicia Reading Terminal with Combined Illumination filed Mar. 19, 2014 (Ouyang);

U.S. patent application Ser. No. 14/336,188 for METHOD OF AND SYSTEM FOR DETECTING OBJECT WEIGHING INTERFERENCES, Filed Jul. 21, 2014 (Amundsen et al.);

U.S. patent application Ser. No. 14/355,613 for Optical Indicia Reading Terminal with Color Image Sensor filed May 1, 2014 (Lu et al.);

U.S. patent application Ser. No. 14/370,237 for WEB-BASED SCAN-TASK ENABLED SYSTEM AND METHOD OF AND APPARATUS FOR DEVELOPING AND DEPLOYING THE SAME ON A CLIENT-SERVER NETWORK filed Jul. 2, 2014 (Chen et al.);

U.S. patent application Ser. No. 14/370,267 for INDUSTRIAL DESIGN FOR CONSUMER DEVICE BASED SCANNING AND MOBILITY, filed Jul. 2, 2014 (Ma et al.);

U.S. patent application Ser. No. 14/376,472, for an ENCODED INFORMATION READING TERMINAL INCLUDING HTTP SERVER, filed Aug. 4, 2014 (Lu);

U.S. patent application Ser. No. 14/379,057 for METHOD OF USING CAMERA SENSOR INTERFACE TO TRANSFER MULTIPLE CHANNELS OF SCAN DATA USING AN IMAGE FORMAT filed Aug. 15, 2014 (Wang et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/460,387 for APPARATUS FOR DISPLAYING BAR CODES FROM LIGHT EMITTING DISPLAY SURFACES filed Aug. 15, 2014 (Van Horn et al.);

U.S. patent application Ser. No. 14/460,829 for ENCODED INFORMATION READING TERMINAL WITH WIRELESS PATH SELECTON CAPABILITY, filed Aug. 15, 2014 (Wang et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/446,387 for INDICIA READING TERMINAL PROCESSING PLURALITY OF FRAMES OF IMAGE DATA RESPONSIVELY TO TRIGGER SIGNAL ACTIVATION filed Jul. 30, 2014 (Wang et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 29/486,759 for an Imaging Terminal, filed Apr. 2, 2014 (Oberpriller et al.);

U.S. patent application Ser. No. 29/492,903 for an INDICIA SCANNER, filed Jun. 4, 2014 (Zhou et al.); and U.S. patent application Ser. No. 29/494,725 for an IN-COUNTER BARCODE SCANNER, filed Jun. 24, 2014 (Oberpriller et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A method for preventing the improper loading of media into a thermal transfer printer, the method comprising:

obtaining access to a media loading area of a thermal transfer printer, the media loading area comprising (i) a thermal transfer paper track that the thermal transfer paper must be routed along for thermal transfer printing and (ii) a thermal transfer ribbon track that the thermal transfer ribbon must be routed along for thermal transfer printing;

positioning a media gate to cover at least part of the thermal transfer ribbon track to block access to at least part of the thermal transfer ribbon track when the thermal transfer paper is being routed along the thermal transfer paper track;

loading the thermal transfer paper into the thermal transfer printer; and routing the thermal transfer paper along the thermal transfer paper track.

2. The method according to claim 1, comprising:

after routing the thermal transfer paper along the thermal transfer paper track, positioning the media gate to cover at least part of the thermal transfer paper track to block access to at least part of the thermal transfer paper track;

loading a thermal transfer ribbon into the thermal transfer printer; and routing the thermal transfer ribbon along the thermal transfer ribbon track.

3. The method according to claim 1, wherein positioning the media gate comprises covering at least part of the thermal transfer ribbon track with a portion of the media gate.

4. The method according to claim 1, wherein the media gate comprises a rectangular plate hingedly connected like a door to the thermal transfer printer.

5. The method according to claim 4, wherein the media gate is held in a position by a magnetic hasp so that access to at least part of the thermal transfer ribbon track is prevented.

6. The method according to claim 4, wherein the media gate comprises printing on at least one side to aid a user with loading media into the thermal transfer printer.

7. The method according to claim 6, wherein the printing comprises at least one icon.

8. A method for preventing the improper loading of a thermal transfer ribbon into a thermal transfer printer, the method comprising:

obtaining access to a media loading area of a thermal transfer printer, the media loading area comprising (i) a thermal transfer paper track that thermal transfer paper must be routed along for thermal transfer printing and (ii) a thermal transfer ribbon track that the thermal transfer ribbon must be routed along for thermal transfer printing;

positioning a media gate to cover at least part of the thermal transfer paper track to block access to at least part of the thermal transfer paper track when the thermal transfer ribbon is being routed along the thermal transfer ribbon track;

loading the thermal transfer ribbon into the thermal transfer printer; and routing the thermal transfer ribbon along the thermal transfer ribbon track.

9. The method according to claim 8, wherein positioning the media gate comprises covering at least part of the thermal transfer paper track with a portion of the media gate.

10. The method according to claim 8, wherein the media gate comprises a rectangular plate hingedly connected like a door to the thermal transfer printer.

11. The method according to claim 8, wherein the media gate is held in a position by a magnetic hasp so that access to at least part of the thermal transfer paper track is prevented.

12. The method according to claim 8, wherein the media gate comprises printing on at least one side to aid a user with loading media into the thermal transfer printer.

13. The method according to claim 12, wherein the printing comprises at least one icon.

14. A thermal transfer printer comprising:

a paper track that continuous feed thermal transfer paper must be routed along for thermal transfer printing;

a ribbon track that a thermal transfer ribbon must be routed along for thermal transfer printing; and a media gate configurable in either (i) a ribbon loading position or (ii) a paper loading position, wherein in the ribbon loading position access to at least part of the paper track is closed while access to the ribbon track is open, and in the paper loading position access to at least part of the ribbon track is closed while access to the paper track is open.

15. The thermal transfer printer according to claim 14, wherein the media gate comprises a door with a pin on one side that is hingedly connected to the thermal transfer printer.

16. The thermal transfer printer according to claim 15, wherein the media gate is rotated 180 degrees about a gate axis collinear with the pin in order to change between the ribbon loading position and the paper loading position.

17. The thermal transfer printer according to claim 15, wherein the media gate is metal and a portion of the media gate is folded around the pin to hold the pin in place.

18. The thermal transfer printer according to claim 15, wherein the media gate comprises a magnet to hold the media gate in either the ribbon loading position or the paper loading position.

19. The thermal transfer printer according to claim 15, wherein the media gate comprises printing on (i) a first side that is visible when the media gate is in the ribbon loading position and (ii) a second side that is visible when the media gate is in the paper loading position.

20. The thermal transfer printer according to claim 19, wherein the printing comprises icons to help a user with loading the thermal transfer ribbon and/or the thermal transfer paper.

* * * * *